US008486170B2

(12) United States Patent
Conrad et al.

(10) Patent No.: US 8,486,170 B2
(45) Date of Patent: Jul. 16, 2013

(54) FILTER APPARATUS

(75) Inventors: Wayne Ernest Conrad, Hampton (CA); Dave Petersen, Hampton (CA)

(73) Assignee: G.B.D. Corp., Nassau (BS)

( * ) Notice: Subject to any disclaimer, the term of this patent is extended or adjusted under 35 U.S.C. 154(b) by 365 days.

(21) Appl. No.: 12/721,004

(22) Filed: Mar. 10, 2010

(65) Prior Publication Data

US 2010/0242421 A1 Sep. 30, 2010

(30) Foreign Application Priority Data

Mar. 13, 2009 (CA) ..... 2658154

(51) Int. Cl.
*B01D 46/00* (2006.01)

(52) U.S. Cl.
USPC ..... 55/309; 55/311; 55/315; 55/321; 55/337; 55/429

(58) Field of Classification Search
USPC ..... 55/309, 311–315, 321–327, 337, 55/429, DIG. 3
See application file for complete search history.

(56) References Cited

U.S. PATENT DOCUMENTS

| | | | | |
|---|---|---|---|---|
| 6,944,909 | B2 * | 9/2005 | Bair et al. | 15/353 |
| 7,144,438 | B2 | 12/2006 | Lee et al. | |
| 2005/0138762 | A1 * | 6/2005 | West | 15/353 |
| 2006/0230720 | A1 * | 10/2006 | Han et al. | 55/345 |

* cited by examiner

*Primary Examiner* — Jason M Greene
*Assistant Examiner* — Karla Hawkins
(74) *Attorney, Agent, or Firm* — Philip C. Mendes da Costa; Bereskin & Parr LLP/S.E.n.C.R.L., s.r.l.

(57) ABSTRACT

A filter apparatus comprises first and second filters, each having an upstream surface and a downstream surface. At least one bypass channel extends from a position upstream of the upstream surface of the first filter to a position upstream of the upstream surface of the second filter.

25 Claims, 6 Drawing Sheets

FILTER APPARATUS

CROSS REFERENCE TO RELATED APPLICATIONS

This application claims the benefit of the filing date of Canadian Patent Application No. 2658154, filed Mar. 13, 2009, entitled FILTER APPARATUS.

FIELD

The specification relates to filter apparatuses. More particularly, this application relates to filter apparatuses for a surface cleaning apparatus.

INTRODUCTION

The following is not an admission that anything discussed below is prior art or part of the common general knowledge of persons skilled in the art.

U.S. Pat. No. 7,144,438 (Samsung Gwangju Electronics Co.) discloses a dust collecting container for a vacuum cleaner. The dust collecting container is removably mounted in a suction chamber of a cleaner body to filter dust from dust-laden air being drawn into the suction chamber through an air suction hole that is connected with the outside. The dust collecting container has a dust collecting casing having a connecting hole connected with the air suction hole and a discharge portion for discharging the drawn air, and a filter assembly having three filters, and removably mounted at the discharge portion.

SUMMARY

The following introduction is provided to introduce the reader to the more detailed discussion to follow. The introduction is not intended to limit or define the claims.

According to one broad aspect, a filter apparatus for a surface cleaning apparatus is provided that has two filters positioned, each of which receives a portion of an air stream. The filters may be provided such that a second downstream filter is connected both in series and in parallel with a first upstream filter, or the first and second filters may be connected only in parallel. Accordingly, one or more channels or passages may be provided to permit some of an air stream to bypass a first filter and proceed to a second filter.

Accordingly a portion of an air stream may be filtered by the first filter, and a portion of the air stream may be filtered by the second filter. The air stream exiting each filter may be recombined. Alternately, the first filter may be positioned upstream from the second filter. Accordingly, the first or upstream filter may have a downstream face that faces an upstream face of the second or downstream filter. Accordingly, air that passes through the upstream filter may then also be filtered by the downstream filter. It will be appreciated that the air exiting the downstream face of the upstream filter may combine with the air that bypasses the upstream filter prior to passing through the downstream filter.

An advantage of this design is that the capacity of a filter may be increased without increasing the surface area of an upstream face of a filter. As the upstream filter becomes clogged by dirt, the air pressure upstream of the upstream face of the upstream filter will increase causing some or additional air to proceed to the downstream filter. Accordingly, the effective filter area is based not only on the surface area of the upstream face of the upstream filter, but also the upstream face of the downstream filter. The system may accordingly be self-balancing to direct air to the downstream filter. Accordingly, increased filtration capacity may be obtained in a smaller footprint.

Accordingly, the bypass channel may serve to maintain airflow in the surface cleaning apparatus if the upstream filter becomes partially or fully clogged. That is, if the upstream filter becomes partially or fully clogged, the air will bypass the upstream filter through the bypass channel, and will reach the upstream surface of the downstream filter.

For example, the filter apparatus may comprise a first filter and a second filter, each having an upstream surface and a downstream surface wherein at least one bypass channel extends from a position upstream of the upstream surface of the first filter to a position upstream of the upstream surface of the second filter.

In some examples, the first filter is mounted in a filter holder, and the filter holder is removably received in a filter housing.

In some examples, the by pass channel is positioned between the filter holder and the filter housing.

In some examples, the filter housing comprises a portion of an outer wall of the surface cleaning apparatus. The portion of the outer wall may extend in a direction of air flow through the first filter.

In some examples, the filter apparatus further comprises a spacer positioned between the first filter downstream surface and the second filter upstream surface. The spacer may comprise a portion of the filter holder, such as feet thereof.

In some examples, at least a portion of the upstream surface of the second filter is spaced from the downstream surface of the first filter. Preferably, these are linearly aligned in the direction of air flow such that downstream surface of the first filter faces, and is preferably proximate, the upstream surface of the second filter.

In some examples, the second filter is removably mounted in the filter housing. The second filter may be separately removably mounted (i.e. separate from the first filter) in the filter housing.

In some examples, the first filter has pores that about the same size as those of the second filter. The first filter and the second filter may each comprise open cell foam.

In some examples, the filter apparatus further comprises an additional filter positioned downstream from the second filter and having pores that are smaller then those of the second filter. The additional filter may comprise felt.

In some examples, a plurality of by pass channels may be provided.

In some examples, the filter apparatus is a pre-motor filter.

The filter apparatus may be used in a surface cleaning apparatus, which may be a portable surface cleaning apparatus. For example, the surface cleaning apparatus may be a hand vacuum cleaner.

It will be appreciated that a filter apparatus may incorporate one or more of the features of each of these examples.

DRAWINGS

In the detailed description, reference will be made to the following drawings, in which.

DESCRIPTION OF VARIOUS EMBODIMENTS

Various apparatuses or methods will be described below to provide an example of each claimed invention. No example described below limits any claimed invention and any claimed invention may cover processes or apparatuses that are not described below. The claimed inventions are not limited to apparatuses or processes having all of the features of any one apparatus or process described below or to features common to multiple or all of the apparatuses described below. It is possible that an apparatus or process described below is not an embodiment of any claimed invention.

Figure 1:
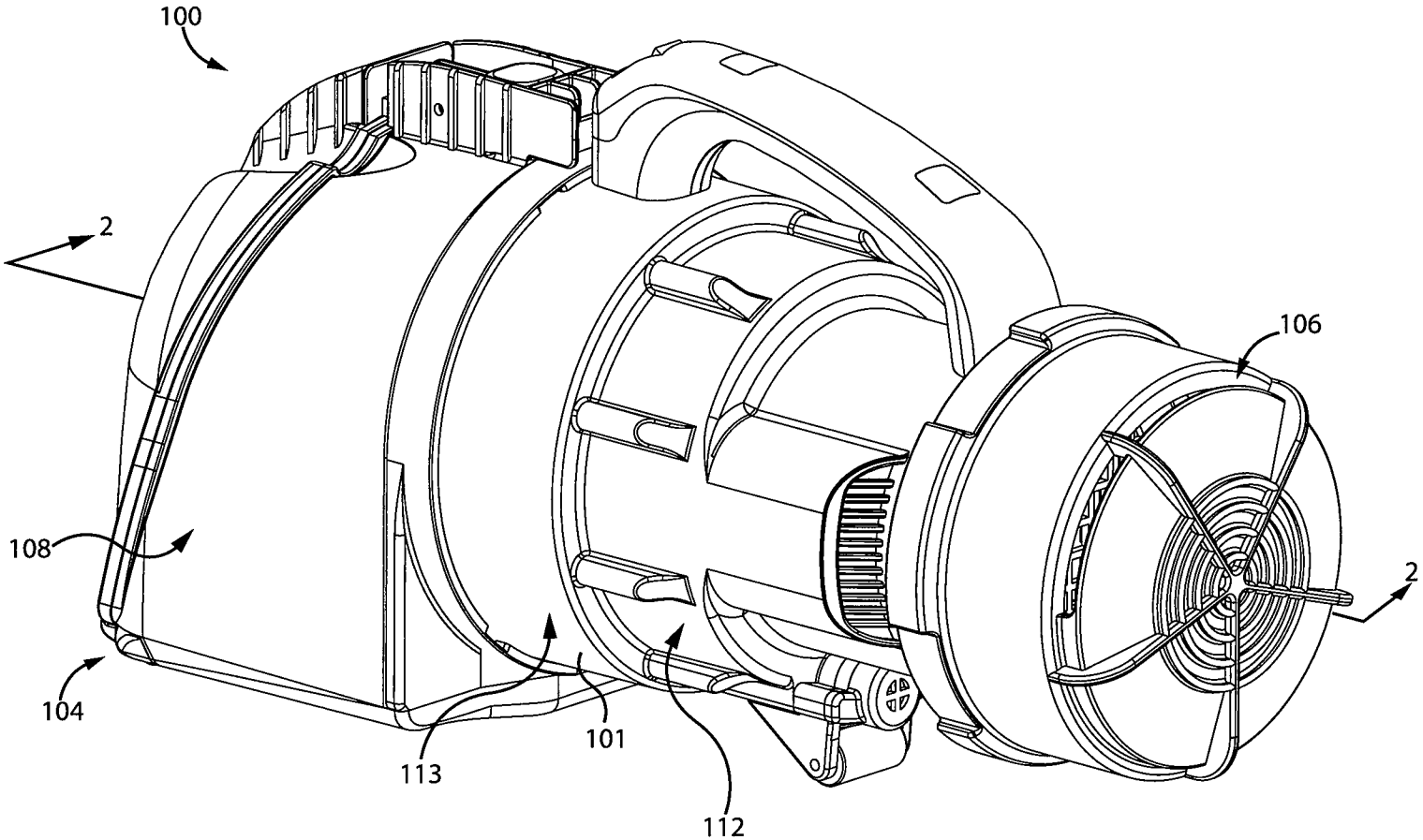
FIG. 1 is a perspective illustration of an exemplary surface cleaning apparatus comprising an embodiment of a filter apparatus.
Figure 2:
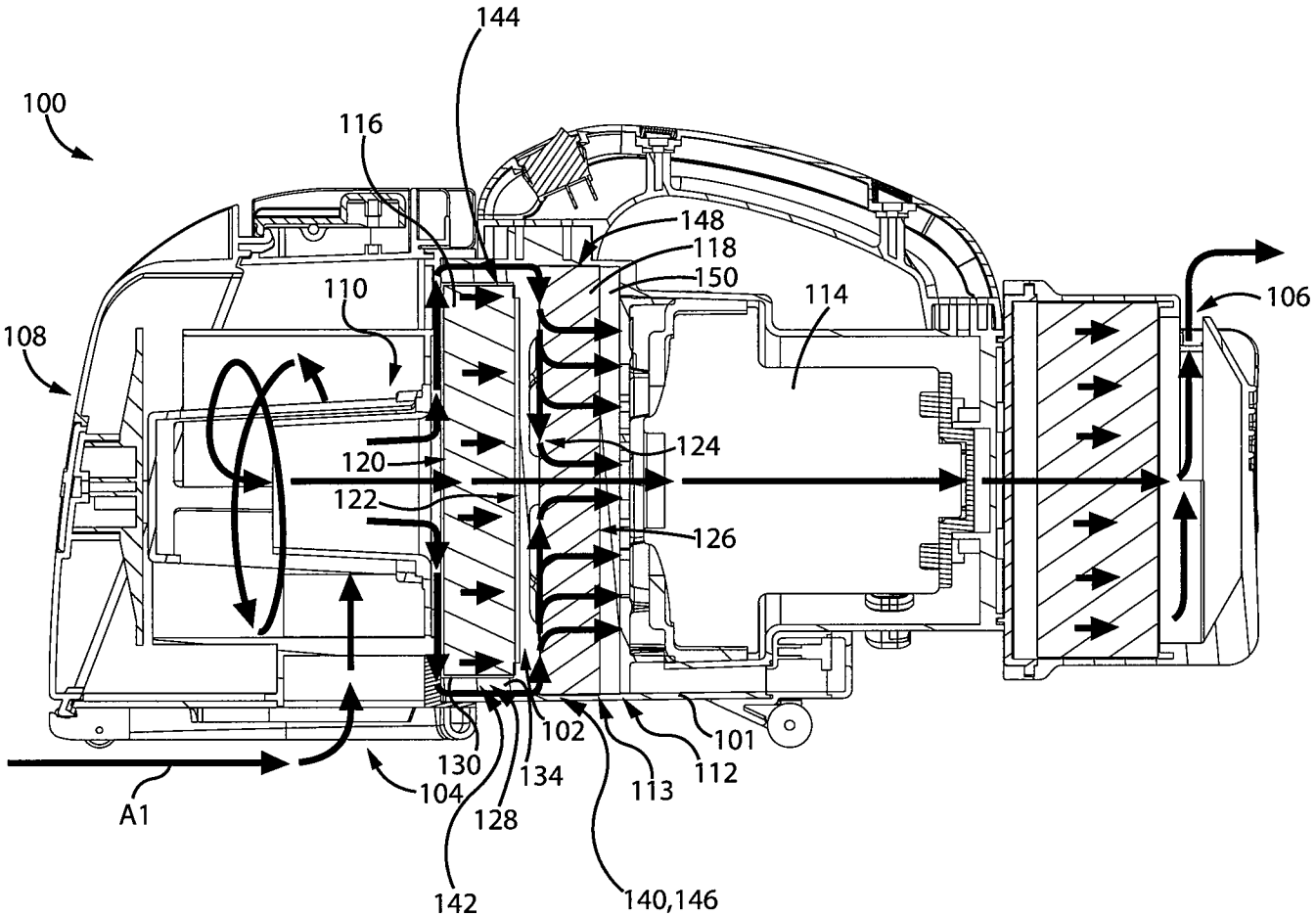
FIG. 2 is a cross section taken along line 2-2 in FIG. 1.

Referring to FIGS. 1 and 2, an exemplary surface cleaning apparatus 100 comprising an embodiment of a filter apparatus 102 is shown. In the embodiment shown, the surface cleaning apparatus 100 is a portable hand vacuum cleaner, and more particularly, is a cyclonic portable hand vacuum cleaner. In alternate embodiments, the filter apparatus 102 may be provided in another type of surface cleaning apparatus, such as an upright vacuum cleaner, a canister-type vacuum cleaner, an extractor or a filter-bag type vacuum cleaner. Such vacuum cleaner may of any design.

Referring still to FIGS. 1 and 2, the surface cleaning apparatus comprises an outer wall 101. An airflow passage extends within the outer wall 101, from a dirty air inlet 104 to a clean air outlet 106. The flow of air through the airflow passage is indicated by arrows A in FIG. 2. A cyclone unit 108 is optionally positioned in the airflow passage, downstream of the dirty air inlet 104. The cyclone unit 108 may comprise a cyclone 110, which removes dirt from air in the airflow passage. A suction motor housing 112 is mounted to the cyclone unit 108, and comprises a portion of the outer wall 101. The suction motor housing 112 houses a motor 114, which draws air through the airflow passage. In the exemplified embodiment, the motor 114 is provided in the airflow passage, downstream of the cyclone unit 108.

As shown in FIG. 2, in the exemplified embodiment, the filter apparatus 102 is provided in the airflow passage, between the cyclone unit 108 and the motor 114. Accordingly, the filter apparatus 102 may be a pre-motor filter. In the embodiment shown, filter apparatus 102 comprises a filter housing 113. Preferably, as shown, the filter housing 113 comprises a portion of the suction motor housing 112 and may be integrally formed therewith. Alternately, or in addition, it is referred that the filter housing 113 comprises a portion of the outer wall 101. In alternate embodiments, the filter apparatus 102 may be positioned elsewhere in the airflow passage, such as downstream of motor 114, or in cyclone unit 108.

Figure 3:
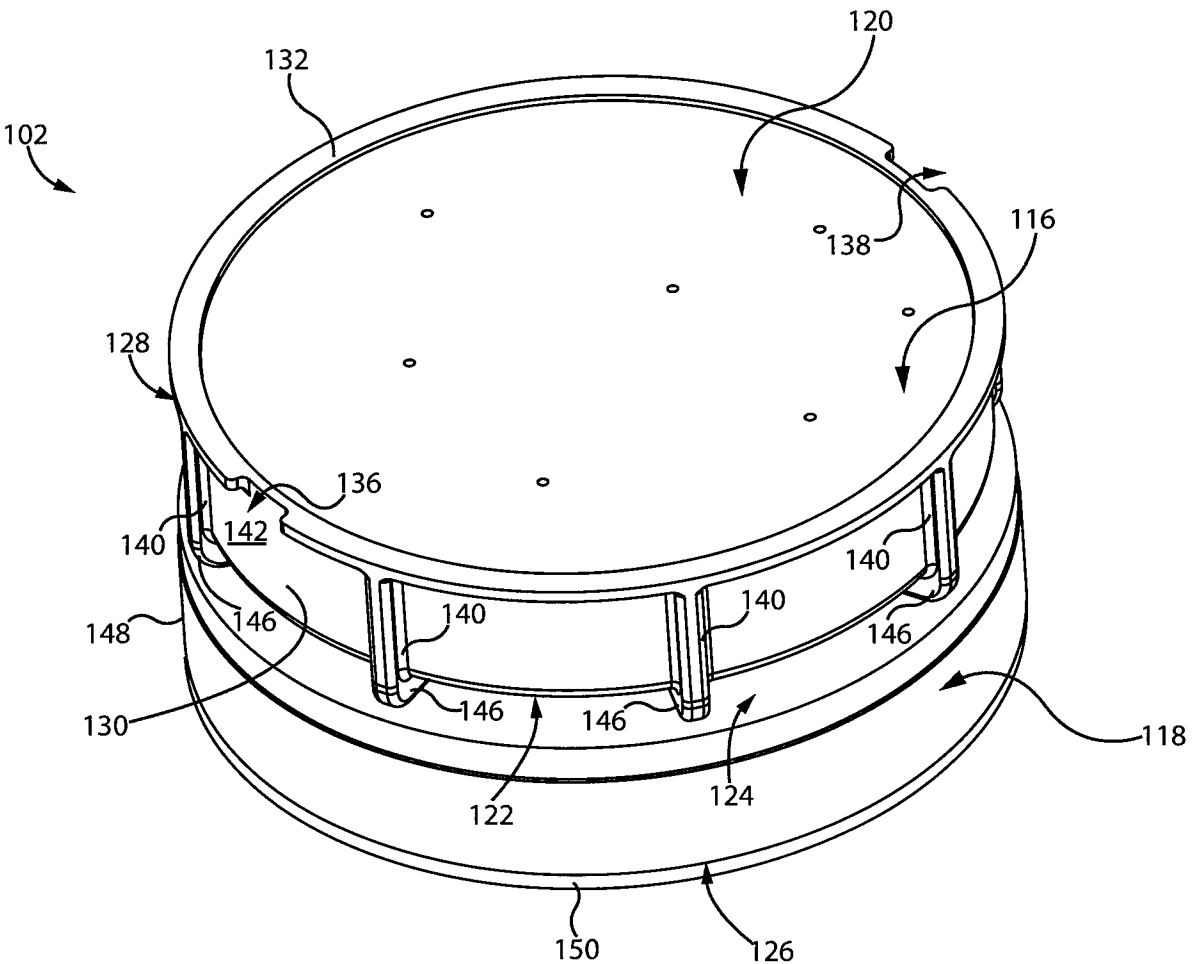
FIG. 3 is a perspective illustration of a portion of a filter apparatus removed from a filter housing.
Figure 4:
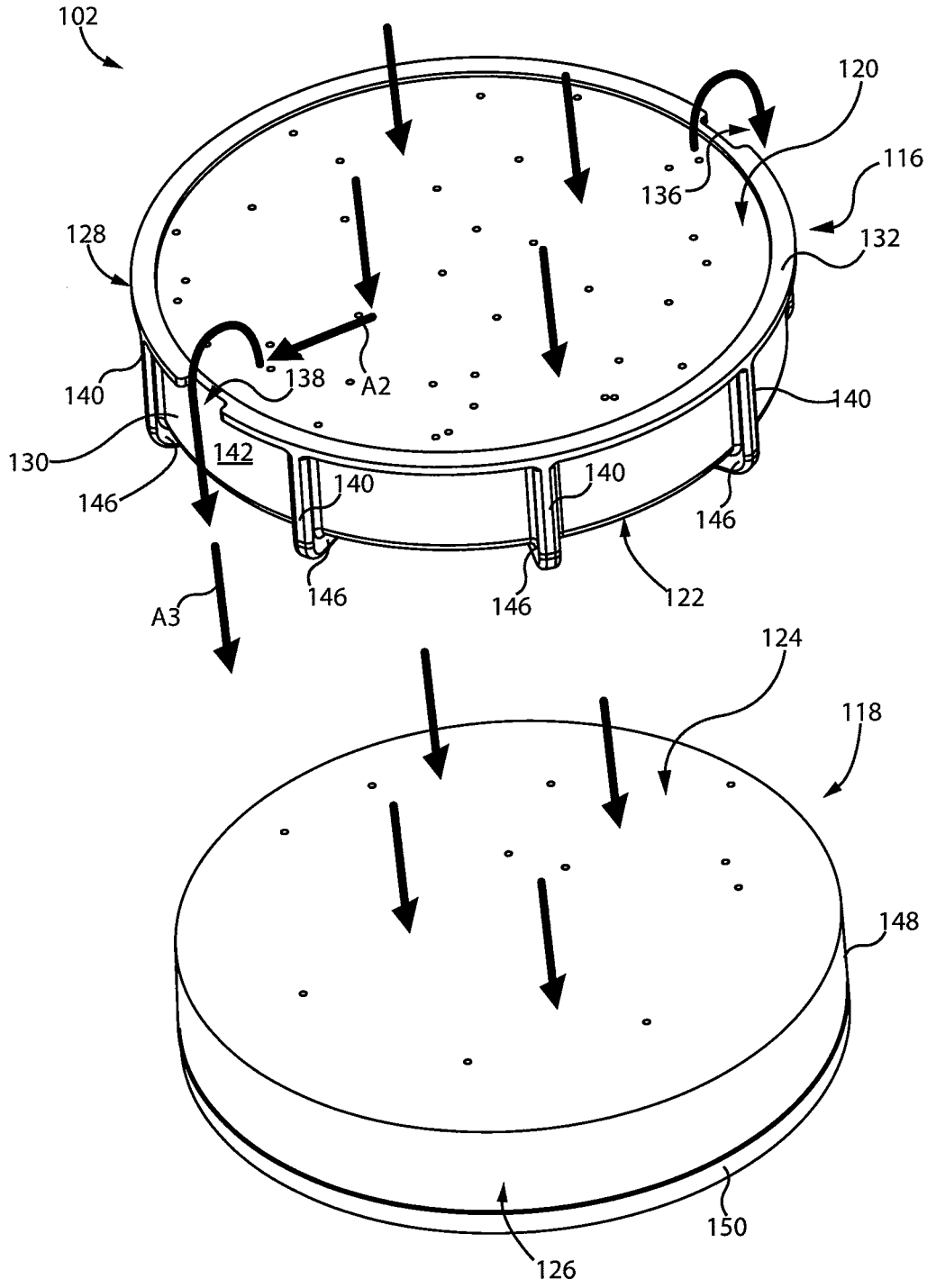
FIG. 4 is an exploded view of the portion of the filter apparatus of FIG. 3.

Referring now to FIGS. 2-4, the filter apparatus 102 may comprise a first or upstream filter 116, and a second or downstream filter 118 housed in the filter housing 113. The upstream 116 and downstream 118 filters may be any suitable type of filter, such as a foam filter, a felt filter, a mesh filter, or any other type of filter. Preferably, the upstream filter 116 and the downstream filter 118 each have the same size pores and accordingly, each may comprise open celled foam.

The upstream filter 116 has an upstream surface 120 and a downstream surface 122. Similarly, the downstream filter 118 has an upstream surface 124 and a downstream surface 126.

Preferably, the upstream filter 116 is mounted in a filter holder 128, which is removably received in the filter housing 113. As exemplified, the filter holder 128 comprises a cylindrical portion 130, within which the upstream filter 116 is received. The upstream filter 116 may be secured therein by any means. For example, upstream filter 116, or a holder 128 therefor, may be frictionally mounted to the cylindrical portion 130. Alternately, the upstream filter 116 may be adhered or mechanically affixed to the cylindrical surface such as by a latch, a detent, Velcro™, a releasable adhesive or the like.

The filter holder 128 may comprise a flange 132, which extends outwardly from the cylindrical portion 130 at an upstream end thereof. The flange 132 may frictionally engage the outer wall of the surface cleaning apparatus to mount the upstream filter 116 to the surface cleaning apparatus. Preferably, the flange 132 frictionally engages an inner surface 134 of the filter housing 113, which preferably extends in a direction of flow through the upstream filter 116. Further, legs 140 may extend downwardly from flange 132, along or spaced from the circumferential inner surface of cylindrical portion 130, and inwardly along the downstream surface 122. Accordingly, the legs 140 may frictionally engage the inner surface 134 of the filter housing 113 as well as, or instead of, flange 132.

The filter apparatus 102 further comprises at least one bypass channel extending from a position upstream of the upstream surface 120 of the upstream filter 116 to a position upstream of the upstream surface 124 of the downstream filter 118. The bypass channel may serve to maintain airflow in the surface cleaning apparatus 100 if the upstream filter 116 becomes partially or fully clogged. That is, if the upstream filter 116 becomes partially clogged, the air will bypass the upstream filter 116 through the bypass channel, and will reach the upstream surface 124 of the downstream filter 118. Preferably, the filter apparatus 102 comprises a plurality of bypass channels. For example, as shown, the filter apparatus 102 comprises two bypass channels, 142, 144. It will be appreciated that if channels 142, 144 are open, then provided that the back pressure through channels 142, 144 is not greater then the back pressure through upstream filter 116, then some air will always pass through the channels. As the back pressure through filter 116 increases, air will start to pass, or more air will pass, through channels 142, 144 to downstream filter 188.

In the exemplified embodiment, the bypass channels are positioned between the filter holder 128 and the filter housing 113. For example, as exemplified, notches 136, 138 are provided in the flange 132, at circumferentially opposed positions thereof. The notches 136, 138, serve as inlets to the bypass channels 142, 144. The bypass channels 142, 144 extend downwardly from the notches 136, 138, between the cylindrical portion 130 and the inner surface 134 of the filter housing 113. Accordingly, referring to FIG. 4, in use, if the upstream filter 116 becomes clogged, air may flow laterally along upstream surface of upstream filter, as shown by arrows A2, downwardly through bypass channels 142, 144 as shown by arrows A3, and may reach the upstream surface 124 of the downstream filter 118.

Preferably, the inlets to the bypass channels 142, 144 are sized such that if the upstream filter 116 is not clogged, the majority of the air passing through the housing 113 will pass through the upstream filter 116, rather than bypassing it.

It will be appreciated that holder 128 may be of any design and need not have open sides.

Preferably, at least one spacer is positioned between the downstream surface 122 of the upstream filter 116 and the upstream surface 124 of the downstream filter 118. More preferably, the spacer comprises a portion of the filter holder 128. For example, as mentioned hereinabove, filter holder 128 may comprise legs 140 which extend in the downstream direction from flange 132, and inwardly along the downstream surface 122. The portion 146 of the legs 140 that extend inwardly may serve as spacers, and maintain the downstream surface 122 of the upstream filter 116 spaced from the upstream surface 124 of the downstream filter 118. Accordingly, air exiting the bypass channels 142, 144, may travel inwardly along the upstream surface 124 of the downstream filter 118. This air may recombine with air exiting the downstream face of the upstream filter 116.

Preferably, as shown, the entire downstream surface 122 of the upstream filter 116 is spaced from the entire upstream surface 124 of the downstream filter 118. However, in alternate embodiments, only a portion of the upstream surface 124 of the downstream filter 118 may be spaced from the downstream surface 122 of the upstream filter 116. For example, legs 140 may be pressed into the upstream surface 124 of the downstream filter 118.

Preferably, as shown, the downstream filter 118 is frictionally mounted in the filter housing 113. That is, a cylindrical outer surface 148 of the downstream filter 118 may frictionally engage the inner surface 134 of the filter housing 113. Accordingly, in the exemplified embodiment, air may not bypass the downstream filter 118.

In alternate embodiments, the downstream filter 118 may be mounted in the filter housing 113 in another manner. For example, a filter holder may be provided for the downstream filter 118. The downstream filter 118 may be secured in position by any other means known the vacuum cleaner art.

In further alternate embodiments, bypass channels may be provided so that air can additionally bypass the downstream filter 118 if the downstream filter 118 becomes clogged, to, e.g., a further downstream filter.

In the embodiment shown, an additional filter 150 is provided. Preferably, as shown, the additional filter 150 is provided downstream of the downstream filter 118, and has pores smaller than those of the downstream filter 118. For example, the additional filter 150 may comprise felt. In alternate embodiments, the additional filter 150 may be provided elsewhere in the surface cleaning apparatus 100, for example downstream of the motor 164, or may not be provided at all. Preferably, the additional filter 150 is mounted to the downstream surface of the downstream filter 118 and may be removable from the filter housing 113 therewith.

Figure 5:
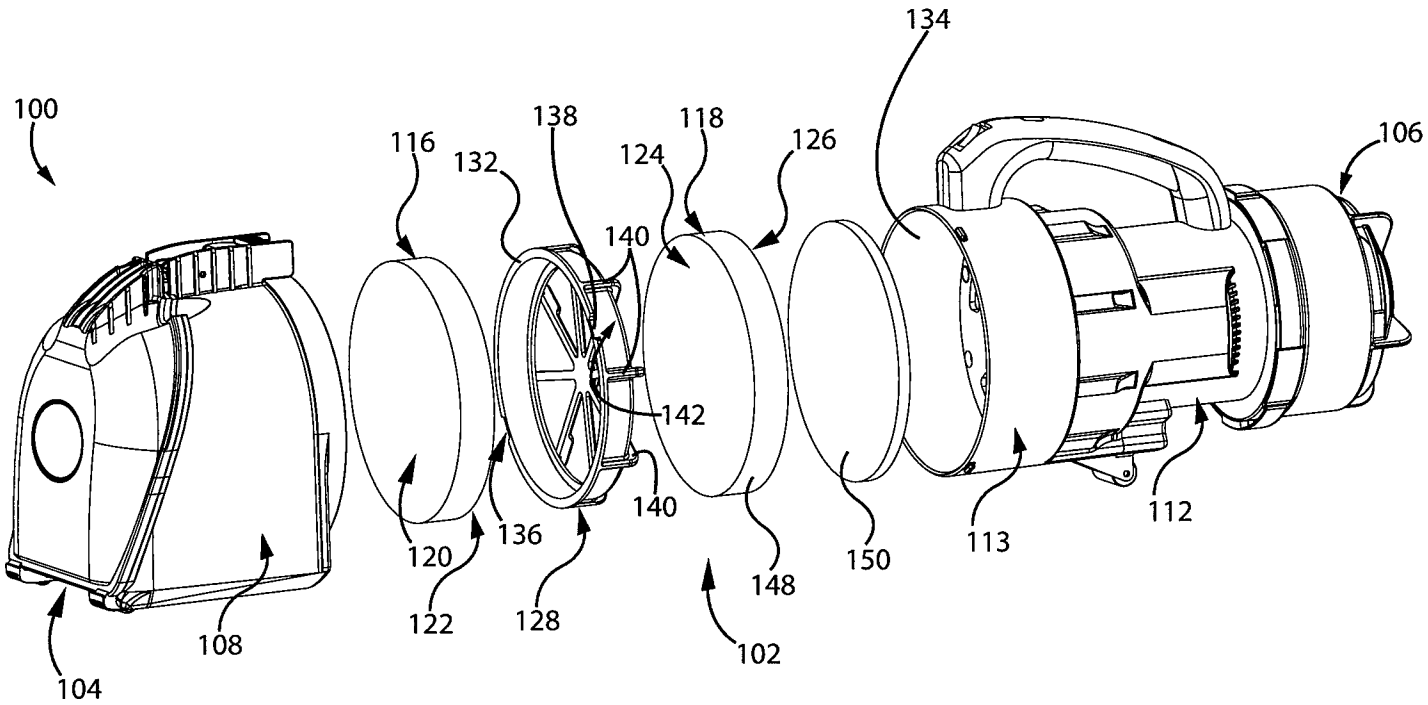
FIG. 5 is a perspective illustration of the surface cleaning apparatus of FIG. 1, showing a filter housing in an open configuration and a filter apparatus removed from the filter housing; and, FIG. 6 is a front plan view of the filter housing of FIG. 5.
Figure 6:
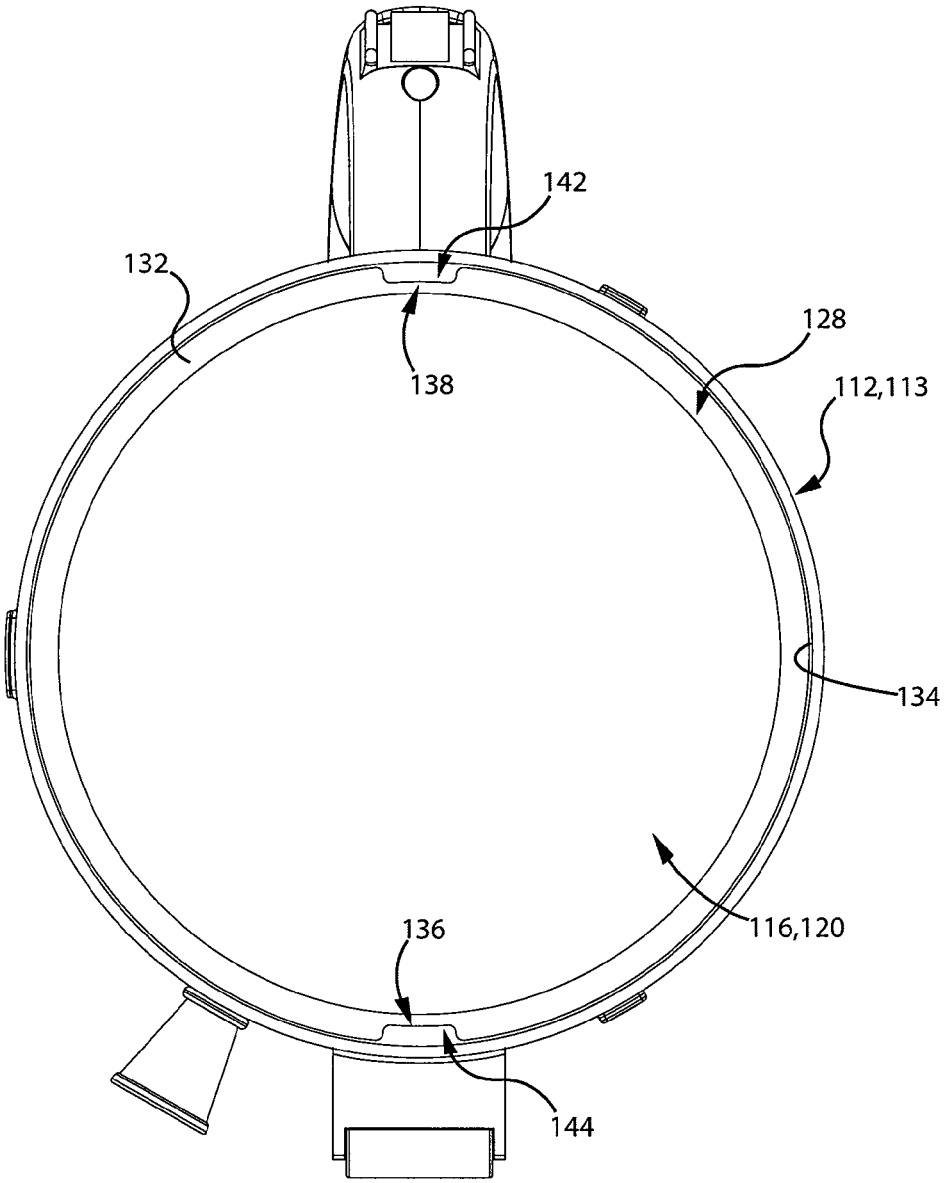

Referring now to FIGS. 5 and 6, preferably, both the upstream filter 116 and the downstream filter 118 are removably mounted in the filter housing 113. For example, in the embodiment shown, the motor housing 112 is removably mounted to the cyclone unit 108, for example by a bayonet mount. When the motor housing 112 is removed from the cyclone unit 108, the upstream surface 120 of the upstream filter 116 is exposed. The upstream filter 116 may then be removed from the housing 113. Further, the downstream filter 118 may then be removed from the housing 113.

Preferably, as exemplified, the downstream filter 118 is separately removably mounted in the filter housing 113. In alternate embodiments, the downstream filter 118 and the upstream filter 116 may be removed together from the filter housing 113. For example, the downstream filter 118 and the upstream filter 116 may be secured together, or the downstream filter 118 and the upstream filter 116 may be mounted in a single filter holder, or each may be mounted in a filter holder and the filter holders may be secured together In the exemplified embodiments, the downstream filter 118 and the upstream filter 116 are disc shaped. It will be appreciated that the outer circumference of the upstream and downstream surfaces of each filter need not be round.

The invention claimed is:

1. A filter apparatus for a surface cleaning apparatus comprising:

(a) a first filter mounted in a filter holder, the first filter having an upstream surface and a downstream surface;

(b) a second filter downstream of the first filter having an upstream surface and a downstream surface; and, (c) at least one bypass channel extending from a position upstream of the upstream surface of the first filter to a position upstream of the upstream surface of the second filter, the bypass channel is positioned between the filter holder and the filter housing.

2. The filter apparatus of claim 1 wherein the first filter and the second filter are connected in series and parallel wherein the first filter is an upstream filter and the second filter is a downstream filter.

3. The filter apparatus of claim 1 wherein the filter holder is removably received in a filter housing.

4. The filter apparatus of claim 1 wherein the filter housing comprises a portion of an outer wall of the surface cleaning apparatus.

5. The filter apparatus of claim 4 wherein the portion of the outer wall extends in a direction of air flow through the first filter.

6. The filter apparatus of claim 1 further comprising a spacer positioned between the first filter downstream surface and the second filter upstream surface.

7. The filter apparatus of claim 6 wherein the spacer comprises a portion of the filter holder.

8. The filter apparatus of claim 1 wherein at least a portion of the upstream surface of the second filter is spaced from and faces the downstream surface of the first filter.

9. The filter apparatus of claim 1 wherein the second filter is removably mounted in the filter housing.

10. The filter apparatus of claim 1 wherein the second filter is separately removably mounted in the filter housing.

11. The filter apparatus of claim 1 wherein the first filter has pores that are about the same size as those of the second filter.

12. The filter apparatus of claim 1 wherein the first filter and the second filter each comprise open cell foam.

13. The filter apparatus of claim 1 further comprising an additional filter positioned downstream from the second filter and having pores that are smaller then those of the second filter.

14. The filter apparatus of claim 13 wherein the additional filter comprises felt.

15. The filter apparatus of claim 1 wherein a plurality of bypass channels are provided.

16. A surface cleaning apparatus comprising a filter apparatus, the filter apparatus comprising:

(a) a first filter having an upstream surface and a downstream surface, and an exterior wall extending between the upstream surface and the downstream surface, the first filter is provided in a filter housing;

(b) a second filter downstream of the first filter having an upstream surface and a downstream surface; and, (c) at least one bypass channel coextensive with the first filter and extending from the upstream surface of the first filter to the downstream surface of the first filter and upstream of the second filter.

17. The surface cleaning apparatus of claim 16 wherein the filter apparatus is a pre-motor filter.

18. The surface cleaning apparatus of claim 16 wherein the surface cleaning apparatus is a portable surface cleaning apparatus.

19. The surface cleaning apparatus of claim 16 wherein the surface cleaning apparatus is a hand vacuum cleaner.

20. The filter apparatus of claim 1 wherein the downstream surface of the first filter faces the upstream surface of the second filter.

21. The filter apparatus of claim 1 wherein the first filter is positioned facing the second filter.

22. The filter apparatus of claim 1 wherein the bypass channel extends from the upstream surface of the first filter to the downstream surface of the first filter and upstream of the second filter.

23. The surface cleaning apparatus of claim 16 wherein the bypass channel is provided in the filter housing.

24. The surface cleaning apparatus of claim 23 wherein the bypass channel extends generally parallel to and spaced from the exterior wall.

25. The surface cleaning apparatus of claim 24 wherein the bypass channel extends between the exterior wall and the filter housing.

* * * * *